US007523039B2

(12) United States Patent
Manu

(10) Patent No.: US 7,523,039 B2
(45) Date of Patent: Apr. 21, 2009

(54) METHOD FOR ENCODING DIGITAL AUDIO USING ADVANCED PSYCHOACOUSTIC MODEL AND APPARATUS THEREOF

(75) Inventor: Mathew Manu, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 959 days.

(21) Appl. No.: 10/652,341

(22) Filed: Sep. 2, 2003

(65) Prior Publication Data

US 2004/0088160 A1 May 6, 2004

Related U.S. Application Data

(60) Provisional application No. 60/422,094, filed on Oct. 30, 2002.

(30) Foreign Application Priority Data

Nov. 29, 2002 (KR) ..... 10-2002-0075407

(51) Int. Cl.
*G10L 19/00* (2006.01)
*G10L 19/14* (2006.01)
*G10L 19/02* (2006.01)

(52) U.S. Cl. ..... 704/501; 704/200.1; 704/201; 704/205

(58) Field of Classification Search ..... 704/203, 704/503, 230; 375/240.16
See application file for complete search history.

(56) References Cited

U.S. PATENT DOCUMENTS

| | | | | |
|---|---|---|---|---|
| 5,394,473 | A * | 2/1995 | Davidson | 704/200.1 |
| 5,732,386 | A * | 3/1998 | Park et al. | 704/203 |
| 6,266,644 | B1 * | 7/2001 | Levine | 704/503 |
| 2003/0093282 | A1 * | 5/2003 | Goodwin | 704/500 |
| 2003/0187634 | A1 * | 10/2003 | Li | 704/200.1 |
| 2003/0215013 | A1 * | 11/2003 | Budnikov | 375/240.16 |
| 2006/0241942 | A1 * | 10/2006 | Chen et al. | 704/230 |

OTHER PUBLICATIONS

Brandenburg K et al:, "ISO-MPEG-1 Audio: A Generic Standard for Coding of High-Quality Digital Audio", Journal of the Audio Engineering Society, Audio Engineering Society, New York, NY, US, vol. 42, No. 10, Oct. 1994, pp. 780-792.

(Continued)

*Primary Examiner*—David R Hudspeth
*Assistant Examiner*—Brian L Albertalli
(74) *Attorney, Agent, or Firm*—Sughrue Mion, PLLC

(57) ABSTRACT

A digital audio encoding method using an advanced psychoacoustic model is provided. The audio encoding method including determining the type of a window according to the characteristic of an input audio signal; generating a complex modified discrete cosine transform (CMDCT) spectrum from the input audio signal according to the determined window type; generating a fast Fourier transform (FFT) spectrum from the input audio signal, by using the determined window type; and performing a psychoacoustic model analysis by using the generated CMDCT spectrum and FFT spectrum.

40 Claims, 8 Drawing Sheets

OTHER PUBLICATIONS

Mathew M et al.: "Modified mp3 encoder using complex modified discrete cosine transform", Multimedia and Expo, 2003. Proceedings. 2003 International Conference on Jul. 6-9, 2003, Piscataway, NJ, USA, IEEE, vol. 2, Jul. 6, 2003, pp. 709-712, XP010650570.

Dimkovic I et al:, "MPEG-4 AAC-Low Delay Communications: Solutions and Business Model", Visualization, Imaging and Image Processing Proceedings of the IASTED International Conference, Sep. 9, 2002, pp. 800-803, XP008020885.

Alberto D. Duenas, et al.., "A Robust and Efficient Implementation of MPEG-2/4 AAC Natural Audio Coders", Audio Engineering Society, Convention Paper, Presented at the 112th Convention, May 10-13, 2002, Munich, Germany.

Ivan Dimkovic, "Improved ISO AAC Coder", http://www.psytel-research.co.yu/papers/di042001.pdf.

* cited by examiner

METHOD FOR ENCODING DIGITAL AUDIO USING ADVANCED PSYCHOACOUSTIC MODEL AND APPARATUS THEREOF

This application claims priorities from U.S. Provisional Patent Application No. 60/422,094 filed on Oct. 30, 2002, and Korean Patent Application No. 2002-75407 filed on Nov. 29, 2002, the contents of which are incorporated herein by reference in their entirety.

BACKGROUND OF THE INVENTION

1. Field of the Invention

The present invention relates to an encoding method and apparatus for encoding digital audio data, and more particularly, to a method and apparatus in which an advanced psychoacoustic model is used so that the amount of computation and complexity needed in the encoding method and apparatus is reduced without degradation of sound quality.

2. Description of the Related Art

A moving picture experts group (MPEG) audio encoder allows a listener not to perceive quantization noise generated when data is encoded. At the same time, the MPEG audio encoder achieves a high compression rate. An MPEG-1 audio encoder standardized by the MPEG encodes an audio signal at a bit rate of 32 kbps~448 kbps. The MPEG-1 audio standard has 3 different algorithms for encoding data.

The MPEG-1 encoder has 3 modes, including layer 1, layer 2, and layer 3. Layer 1 implements a basic algorithm, while layers 2 and 3 are enhanced modes. The layers at higher levels achieve a higher compression rate, but on the other hand, the size of the hardware becomes larger.

The MPEG audio encoder uses a psychoacoustic model which closely mirrors a characteristic of human hearing, in order to reduce perceptual redundancy of a signal of an audio encoder. The MPEG1 and MPEG2, standardized by the MPEG, employ a perceptual coding method using a psychoacoustic model which reflects the characteristic of human perception and removes perceptual redundancy such that a good sound quality can be maintained after decoding data.

The perceptual coding method, by which a human psychoacoustic model is analyzed and applied, uses a threshold in a quiet and a masking effect. The masking effect is a phenomenon in which a small sound less than a predetermined threshold is masked by a big sound, and this masking between signals existing in an identical time interval is also referred to as frequency masking. At this time, depending on the frequency band, the threshold of the masked sound varies.

By using the psychoacoustic model, a maximum noise model that is inaudible in each subband of a filter band can be determined. With this noise level in each subband, that is, with the masking threshold, a signal to mask ratio (SMR) value of each subband can be obtained.

The coding method using the psychoacoustic model is disclosed in the U.S. Pat. No. 6,092,041, "System and method of encoding and decoding a layered bitstream by re-applying psychoacoustic analysis in the decoder" assigned to Motorola, Inc.

FIG. 1 is a block diagram showing an ordinary MPEG audio encoding apparatus. Here, among the MPEG audio encoders, the MPEG-1 layer 3 audio encoder, that is, the MP3 audio encoder, will now be explained as an example.

The MP3 encoder comprises a filter bank 110, a modified discrete cosine transform (MDCT) unit 120, a fast Fourier transform (FFT) unit 130, a psychoacoustic model unit 140, a quantization and Huffman encoding unit 150, and a bitstream formatting unit 160.

The filter bank 110 divides an input time domain audio signal into 32 frequency domain subbands in order to remove statistical redundancy of the audio signal.

By using window switching information input from the psychoacoustic model unit 140, the MDCT unit 120 divides the subbands, which are divided in the filter bank 110, into finer frequency bands in order to increase frequency resolution. For example, if the window switching information, which is input from the psychoacoustic model unit 140, indicates a long window, the 32 subbands are divided into finer frequency bands by using 36 point MDCT, and if the window switching information indicates short window, the 32 subbands are divided into finer frequency bands by using 12 point MDCT.

The FFT unit 130 converts the input audio signal into a frequency domain spectrum and outputs the spectrum to the psychoacoustic model unit 140.

In order to remove perceptual redundancy according to the characteristic of human hearing, the psychoacoustic model unit 140 uses the frequency spectrum output from the FFT unit 130 and determines a masking threshold that is a noise level inaudible in each subband, that is, an SMR. The SMR value determined in the psychoacoustic model unit 140 is input to the quantization and Huffman encoding unit 150.

In addition, the psychoacoustic model unit 140 calculates a perceptual energy level to determine whether or not to perform window switching, and outputs window switching information to the MDCT unit 120.

In order to process the frequency domain data which is input from the MDCT unit 120 after the MDCT is performed, the quantization and Huffman encoding unit 150 performs bit allocation to remove perceptual redundancy and quantization to encode the audio data, based on the SMR value input from the psychoacoustic model unit 140.

The bit stream formatting unit 160 formats the encoded audio signal, which is input from the quantization and Huffman encoding unit 150, into bit streams specified by the MPEG and outputs the bit streams.

As described above, the prior art psychoacoustic model shown in FIG. 1 uses the FFT spectrum obtained from the input audio signal in order to calculate the masking threshold. However, the filter bank causes aliasing and values obtained from components in which aliasing has occurred are used in the quantization step. In the psychoacoustic model, if an SMR is obtained based on the FFT spectrum and the SMR is used in the quantization step, an optimal result cannot be obtained.

SUMMARY OF THE INVENTION

The present invention provides a digital audio encoding method and apparatus in which a modified psychoacoustic model is used so that the sound quality of an output audio stream can be improved and the amount of computation in the digital audio encoding step can be reduced, when compared to the prior art MPEG audio encoder.

According to an aspect of the present invention, there is provided a digital audio encoding method comprising determining the type of a window according to the characteristic of an input audio signal; generating a complex modified discrete cosine transform (CMDCT) spectrum from the input audio signal according to the determined window type; generating a fast Fourier transform (FFT) spectrum from the input audio signal, by using the determined window type; and performing a psychoacoustic model analysis, by using the generated CMDCT spectrum and FFT spectrum.

In the digital audio encoding method, when the determined window type is a long window, a long window is applied to generate a long CMDCT spectrum, a short window is applied to generate an FFT spectrum, and based on the generated long CMDCT spectrum and short FFT spectrum, a psychoacoustic model analysis is performed.

According to another aspect of the present invention, there is provided a digital audio encoding apparatus comprising: a window switching unit which determines the type of a window according to the characteristic of an input audio signal; a CMDCT unit which generates a CMDCT spectrum from the input audio signal according to the window type determined in the window switching unit; an FFT unit which generates an FFT spectrum from the input audio signal, by using the window type determined in the window switching unit; and a psychoacoustic model unit which performs a psychoacoustic model analysis by using the CMDCT spectrum generated in the CMDCT unit and the FFT spectrum generated in the FFT unit.

In the apparatus, if the window type determined in the window switching unit is a long window, the CMDCT unit generates a long CMDCT spectrum by applying a long window, the FFT unit generates a short FFT spectrum by applying a short window, and the psychoacoustic model unit performs a psychoacoustic model analysis based on the long CMDCT spectrum generated in the CMDCT unit and the short FFT spectrum generated in the FFT unit.

According to still another aspect of the present invention, there is provided a digital audio encoding method comprising generating a CMDCT spectrum from an input audio signal; and performing a psychoacoustic model analysis by using the generated CMDCT spectrum.

The method may further comprise generating a long CMDCT spectrum and a short CMDCT spectrum by performing CMDCT by applying a long window and a short window to an input audio signal.

In the method, a psychoacoustic model analysis is performed by using the generated long CMDCT spectrum and short CMDCT spectrum.

In the method, if the determined window type is a long window, quantization and encoding of a long MDCT spectrum are performed based on the result of the psychoacoustic model analysis, and if the determined window type is a short window, quantization and encoding of a short MDCT spectrum are performed based on the result of the psychoacoustic model analysis.

According to yet still another aspect of the present invention, there is provided a digital audio encoding apparatus comprising a CMDCT unit which generates a CMDCT spectrum from an input audio signal; and a psychoacoustic model unit which performs a psychoacoustic analysis by using the CMDCT spectrum generated in the CMDCT unit.

In the apparatus, the CMDCT unit generates a long CMDCT spectrum and a short CMDCT spectrum, by performing CMDCT by applying a long window and a short window to the input audio signal.

In the apparatus, the psychoacoustic model unit performs a psychoacoustic analysis by using the long CMDCT spectrum and short CMDCT spectrum generated in the CMDCT unit.

The apparatus further comprises a quantization and encoding unit and if the window type determined in the window type determining unit is a long window, the quantization and encoding unit performs quantization and encoding of a long MDCT spectrum, based on the result of the psychoacoustic model analysis and if the window type determined in the window type determining unit is a short window, performs quantization and encoding of a short MDCT spectrum, based on the result of the psychoacoustic model analysis.

Since the MPEG audio encoder requires a very large amount of computation, it is difficult to apply the MPEG audio encoder to real-time processing. Though it is possible to simplify the encoding algorithm by degrading the sound quality of the output audio, it is very difficult to reduce the amount of computation without degrading the sound quality.

In addition, the filter bank used in the prior art MPEG audio encoder causes aliasing. Since the values obtained from the components where the aliasing occurred are used in the quantization step, it is preferable that a psychoacoustic model is applied to a spectrum where the aliasing occurred.

Also, as shown in Equation 2 which will be explained later, an MDCT spectrum provides the values of size and phase in a frequency $2\pi(k+0.5)/N$, $k=0, 1, \ldots, N/2-1$. Accordingly, it is preferable that a spectrum in the frequencies is calculated and a psychoacoustic model is applied.

Also, CMDCT is applied to the output of the filter bank to calculate the spectrum of an input signal, and a psychoacoustic model is applied according to the spectrum such that the amount of computation needed in the FFT transform can be reduced compared to the prior art MPEG audio encoder, or the FFT transform process can be omitted.

The present invention is based on the facts described above and an audio encoding method and apparatus according to the present invention can reduce the complexity of an MPEG audio encoding processor without degrading the sound quality of an MPEG audio stream.

BRIEF DESCRIPTION OF THE DRAWINGS

The above objects and advantages of the present invention will become more apparent by describing in detail preferred embodiments thereof with reference to the attached drawings in which.

DESCRIPTION OF THE PREFERRED EMBODIMENTS

Referring to Equations 1 through 4, algorithms used in the present invention will now be explained in detail.

The filter bank divides an input signal to a resolution of $\pi/32$. As described below, it is possible to calculate the spectrum of an input signal by applying CMDCT to the output value of the filter bank. At this time, the transform length is much shorter than a transform length when CMDCT is directly applied to an input signal without using the output value of the filter bank. Using this short transform value for the filter bank output can reduce the amount of computation compared to using a long transform value.

CMDCT can be obtained by the following Equation 1:

$$X(k)=X_C(k)+jX_S(k) \quad \text{EQN.(1)}$$

wherein, k=0, 1, 2, . . . , N/2−1.

In this case, $X_C(k)$ denotes MDCT and $X_S(k)$ denotes modified discrete sine transform (MDST). The following derivative Equations 2 through 4 explain the relationships between CMDCT and FFT.

$$X_C(k) = \sum_{n=0}^{N-1} x(n)\text{Cos}\{2\pi(k+0.5)(n+0.5+N/4)/N\} = \sum_{n=0}^{N-1} x(n)\text{Cos}\{2\pi n(k+0.5)/N+\Phi_k\} \quad \text{EQN. (2)}$$

wherein, $\Phi_k=2\pi(k+0.5)(N/4+0.5)/N$, and k=0, 1, . . . , N/2−1.

Also, MDST can be expressed as the MDCT in the following Equation 3:

$$X_S(k) = \sum_{n=0}^{N-1} x(n)\text{Sin}\{2\pi(k+0.5)(n+0.5+N/4)/N\} = \sum_{n=0}^{N-1} x(n)\text{Sin}\{2\pi n(k+0.5)/N+\Phi_k\} \quad \text{EQN. (3)}$$

wherein, k=0, 1, . . . , N/2−1.

Also, assuming that $\bar{x}(k)$ denotes the complex conjugate of CMDCT, $\bar{x}(k)$ can be obtained as the following Equation 4:

$$\bar{x}(k) = X_C(k) - jX_S(k) = \sum_{n=0}^{N-1} e^{j\{2\pi n(k+0.5)/N+\Phi_k\}} = e^{-j\Phi_k} X'(k) \quad \text{EQN. (4)}$$

wherein, $$X'(k) = \sum_{n=0}^{N-1} e^{j\{2\pi n(k+0.5)/N\}}, \text{ and } k = 0, 1, \ldots, N/2-1.$$

As shown in Equation 4, the complex conjugate of CMDCT is obtained by calculating a spectrum between frequencies of DFT spectrum, that is, frequencies of 2π(k+0.5)/N, k=0, 1, . . . , N/2−1.

The phase of CMDCT is obtained by shifting the phase of X'(k), and this phase shift does not affect the calculation of an unpredictability measure in a psychoacoustic model of the MPEG-1 layer 3.

Considering this, the psychoacoustic model according to the present invention uses a CMDCT spectrum instead of an FFT spectrum, or a long CMDCT spectrum or a short CMDCT spectrum instead of a long FFT spectrum or a short FFT spectrum when a psychoacoustic model is analyzed. Accordingly, the amount of computation needed in FFT transform can be reduced.

The present invention will now be explained in detail referring to preferred embodiments.

Figure 1:
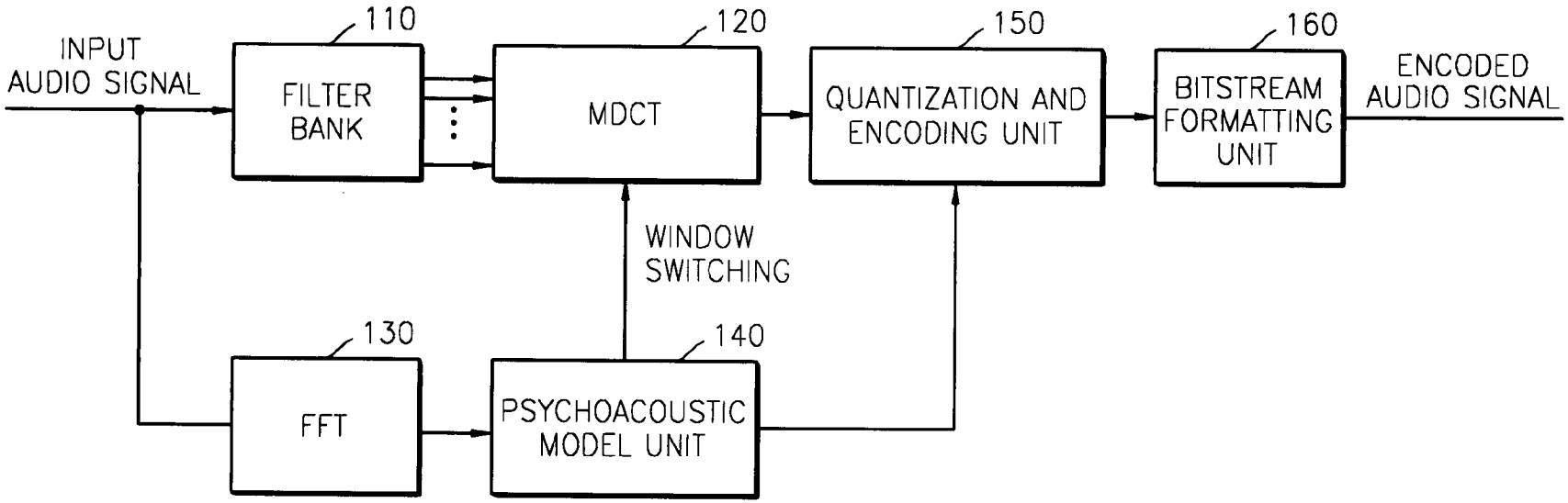
FIG. 1 is a block diagram showing a prior art MPEG audio encoding apparatus.
Figure 2:
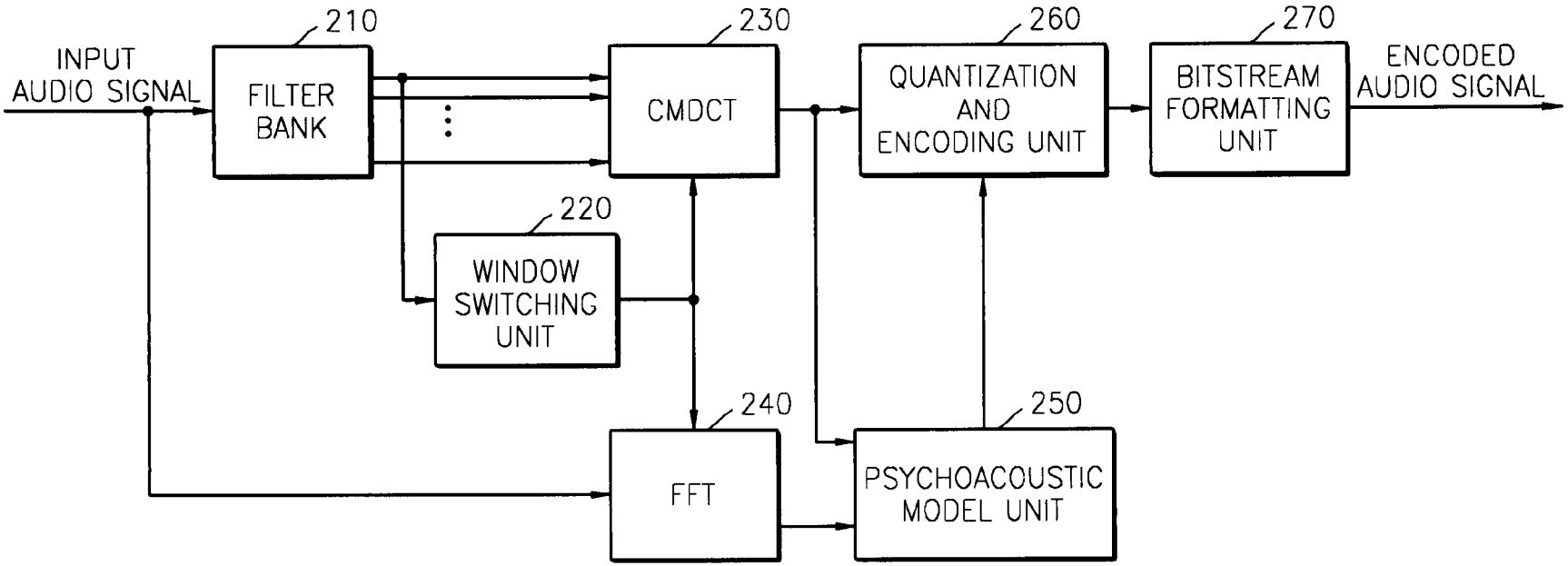
FIG. 2 is a block diagram showing an MPEG audio encoding apparatus according to a preferred embodiment of the present invention.

FIG. 2 is a block diagram showing an audio encoding apparatus according to a preferred embodiment of the present invention.

A filter bank 210 divides an input time domain audio signal into a plurality of frequency domain subbands in order to remove the statistical redundancy of the input audio signal. In the present embodiment, the audio signal is divided into 32 subbands each having a bandwidth of π/32. Though a 32 poly-phase filter bank is used in the present embodiment, other filters capable of subband encoding can be used selectively.

The window switching unit 220 determines a window type to be used in a CMDCT unit 230 and an FFT unit 240, based on the characteristic of an input audio signal, and inputs the determined window type information to the CMDCT unit 230 and the FFT unit 240.

The window type is broken down into a short window and a long window. In the MPEG-1 layer 3, a long window, a start window, a short window, and a stop window are specified. At this time, the start window or the stop window is used to switch the long window to the short window. Although in the present embodiment, the window types specified in the MPEG-1 are explained as examples, the window switching algorithm can be performed according to other window types selectively. The window switching algorithm according to the present invention will be explained later in detail by referring to FIGS. 3 and 4.

The CMDCT unit 230 performs CMDCT by applying the long window or short window to the output data of the filter bank 210, based on the window type information input from the window switching unit 220.

The real part of the CMDCT value that is calculated in the CMDCT unit 230, that is, the MDCT value, is input to a quantization and encoding unit 260.

Also, the CMDCT unit 230 calculates a full spectrum by adding calculated subband spectra and sends the calculated full spectrum to the psychoacoustic model unit 250. The process of obtaining a full spectrum from subband spectra will be explained later referring to FIG. 5.

Selectively, a LAME algorithm may be used for fast execution of MDCT. In the LAME algorithm, MDCT is optimized by unrolling the Equation 1. By using the symmetry of trigonometric coefficients related to calculation, contiguous multiplications by identical coefficients are replaced by addition operations. For example, the number of multiplications is reduced by replacing 224 multiplications with 324 additions, and for 36 point MDCT, the MDCT time decreases by about 70%. This algorithm can also be applied to the MDST.

Based on the window type information from the window switching unit 220, the FFT unit 240 uses a long window or a short window for the input audio signal to perform FFT, and outputs the calculated long FFT spectrum or short FFT spectrum to the psychoacoustic model unit 250. At this time, if the window type used in the CMDCT unit 230 is a long window, the FFT unit 240 uses a short window. That is, if the output of the CMDCT unit 230 is a long CMDCT spectrum, the output of the FFT unit 240 becomes a short FFT spectrum. Likewise, if the output of the CMDCT unit 230 is a short CMDCT spectrum, the output of the FFT unit 240 becomes a long FFT spectrum.

The psychoacoustic model unit 250 combines the CMDCT spectrum from the CMDCT unit 230 and the FFT spectrum from the FFT unit 240, and calculates the unpredictability used in a psychoacoustic model.

For example, when a long window is used in CMDCT, the long spectrum is calculated by using the resultant values of long MDCT and long MDST, and the short spectrum is calculated by using the FFT. Here, the reason why the CMDCT spectrum calculated in the CMDCT unit 230 is used for the long spectrum is based on the fact that the sizes of FFT and MDCT are similar to each other, which can be shown in the Equations 3 and 4.

Also, when a short window is used in CMDCT, the short spectrum is calculated by using the resultant values of short MDCT and short MDST, and the long spectrum is calculated by using the FFT.

Meanwhile, the CMDCT spectrum calculated in the CMDCT unit 230 has the length of 1152 (32 subbands×36 sub-subbands) when the long window is applied, and has the length of 384 (32 subbands×12 sub-subbands) when the short window is applied. On the other hand, the psychoacoustic model unit 250 needs a spectrum having a length of 1024 or 256.

Accordingly, the CMDCT spectrum is re-sampled from the length of 1152 (or 384) into the length of 1024 (or 256) by linear mapping before the psychoacoustic model analysis is performed.

Also, the psychoacoustic model unit 250 obtains an SMR value, by using the calculated unpredictability, and outputs the SMR value to the quantization and encoding unit 260.

The quantization and encoding unit 260 determines a scale factor, and determines quantization coefficients based on the SMR value calculated in the psychoacoustic model unit 250. Based on the determined quantization coefficients, the quantization and encoding unit 260 performs quantization, and with the quantized data, performs Huffman encoding.

A bitstream formatting unit 270 converts the data input from the quantization and encoding unit 260, into a signal having a predetermined format. If the audio encoding apparatus is an MPEG audio encoding apparatus, the bitstream formatting unit 270 converts the data into a signal having a format specified by the MPEG standards, and outputs the signal.

Figure 3:
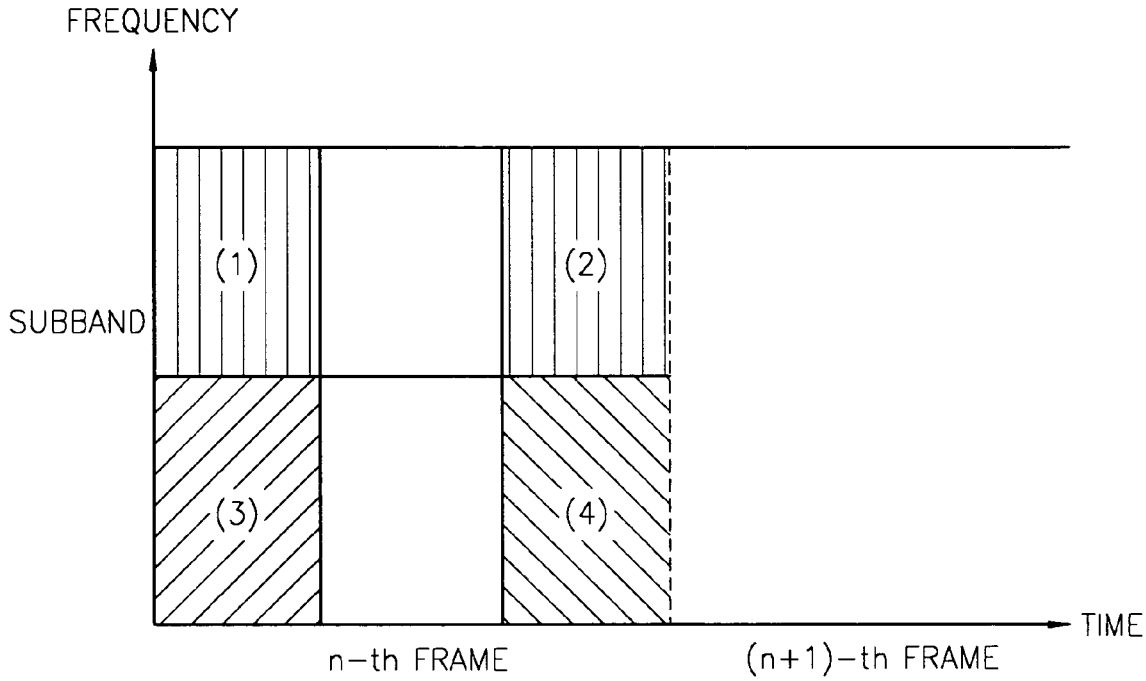
FIG. 3 is a diagram showing a method for detecting a transient signal used in a window switching algorithm according to the present invention.

FIG. 3 is a diagram showing a method for detecting a transient signal used in a window switching algorithm based on the output of the filter bank 210 used in the window switching unit 220 of FIG. 2.

According to the MPEG audio standards specified by the MPEG, an actual window type is determined based on the window type of a current frame and the window-switching flag of the next frame. The psychoacoustic model determines a window switching flag based on perceptual entropy. Accordingly, the psychoacoustic modeling needs to be performed on at least one frame that precedes a frame that is being processed in a filter bank and MDCT unit.

On the other hand, the psychoacoustic model according to the present invention uses a CMDCT spectrum as described above. Therefore, the window type should be determined before CMDCT is applied. Also, with this reason, a window-switching flag is determined from the output of the filter bank, and the filter bank unit and window switching unit process a frame that precedes one frame before a frame being processed for quantization and psychoacoustic modeling.

As shown in FIG. 3, the input signal from the filter bank is divided into 3 time bands and 2 frequency bands, that is, 6 bands in total. In FIG. 3, on the horizontal axis, a frame is divided into 36 samples, that is, 3 time bands each having 12 samples. On the vertical axis, a frame is divided into 32 subbands, that is, 2 frequency bands each having 16 subbands. Here, 36 samples and 32 subbands correspond to 1152 sample inputs.

The parts marked by slanted lines indicate parts used for detecting a transient signal, and for convenience of explanation, the parts marked by slanted lines will be referred to as (1), (2), (3), and (4) as shown in FIG. 3. Assuming that energies in regions (1) through (4) are E1, E2, E3, and E4, respectively, energy ratio E1/E2 between regions (1) and (2), and energy ratio E3/E4 between regions (3) and (4) are transient indicators that indicate whether or not there is a transient signal.

When a signal is a non-transient signal, the value of the transient indicator is within a predetermined range. Accordingly, if a transient indicator exceeds the predetermined range, the window switching algorithm indicates that a short window is needed.

Figure 4:
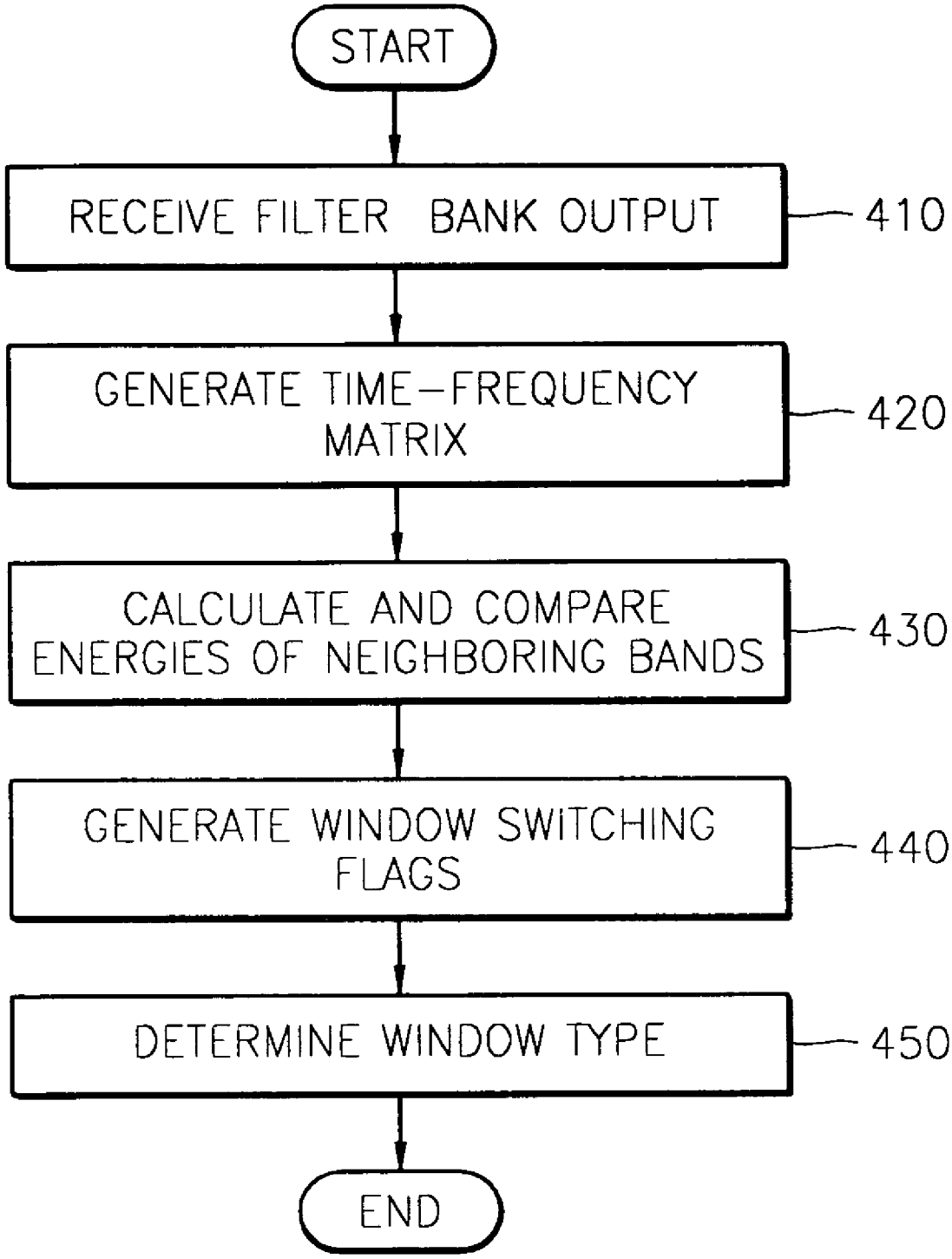
FIG. 4 is a flowchart of the steps performed by a window switching algorithm used in the present invention.

FIG. 4 is a flowchart of the steps performed by a window switching algorithm used in the window switching unit 220 shown in FIG. 2.

In step 410, a filter bank output of one frame having 32 subbands, each of which has 36 output samples, is input.

In step 420, as shown in FIG. 3, the input signal is divided into 3 time bands, each having 12 sample values, and 2 frequency bands, each having 16 subbands.

In step 430, energies E1, E2, E3, and E4 of bands, which are used to detect a transient signal, are calculated.

In step 430, in order to determine whether or not there is transient in the input signal, the calculated energies are compared. That is, E1/E2 and E3/E4 are calculated.

In step 440, based on the calculated energy ratios of neighboring bands, it is determined whether or not there is transient in the input signal. When there is transient in the input signal, a window flag to indicate a short window is generated, and when there is no transient, a window switching flag to indicate a long window is generated.

In step 450, based on the window switching flag generated in the step 440 and the window used in the previous frame, a window type that is actually applied is determined. The applied window type may be one of 'short', 'long stop', 'long start', and 'long' used in the MPEG-1 standards.

Figure 5:
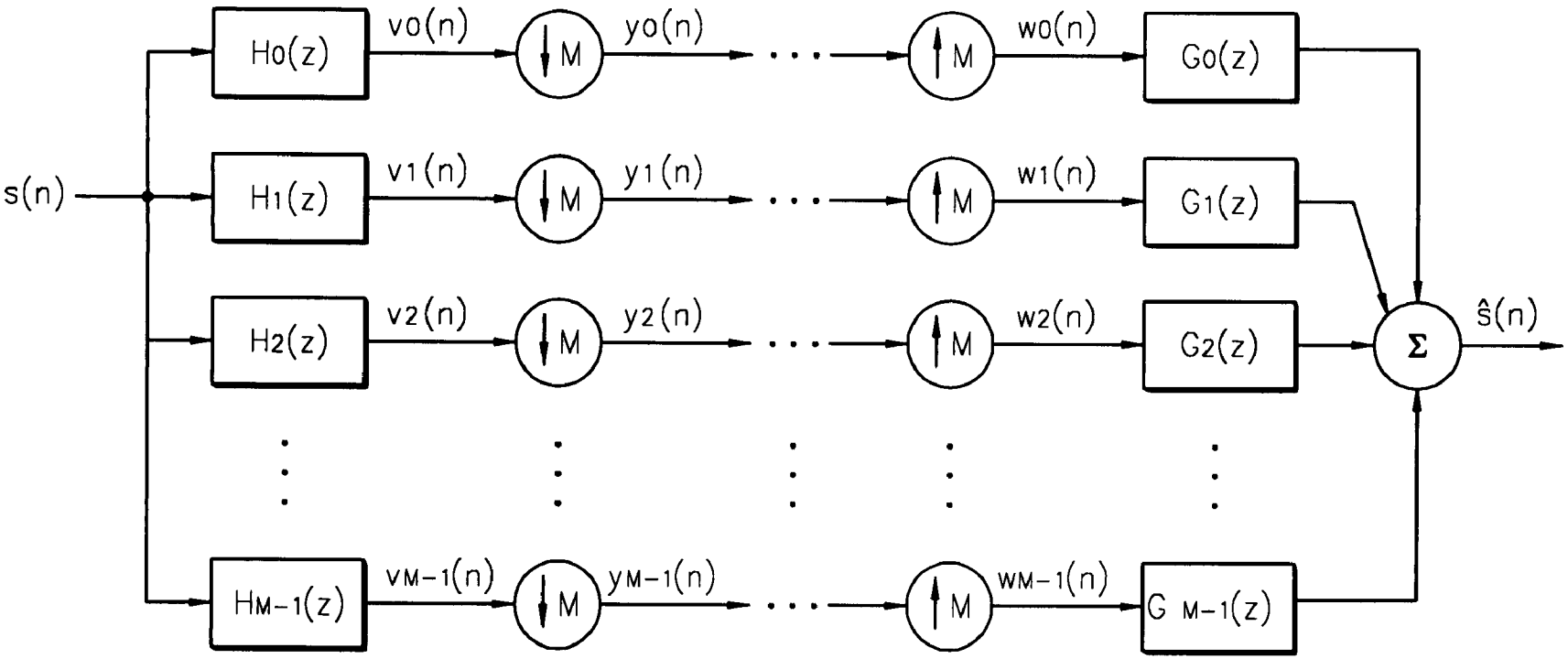
FIG. 5 is a diagram showing a method for obtaining an entire spectrum from subband spectra according to the present invention.

FIG. 5 is a diagram showing a method for obtaining an entire spectrum from subband spectra according to the present invention.

Referring to FIG. 5, a method for approximately calculating a signal spectrum from a spectrum calculated from the output of a subband filter bank will now be explained.

As shown in FIG. 5, an input signal is filtered by analysis filters, $H_0(Z), H_1(Z), H_2(Z), \ldots, H_{M-1}(Z)$, and downsampled. Then, the downsampled signals, $y_0(n), y_1(n), y_2(n), \ldots, y_{M-1}(n)$, are upsampled, filtered by synthesis filters, $G_0(Z), G_1(Z), G_2(Z), \ldots, G_{M-1}(Z)$, and combined in order to reconstruct a signal.

This process corresponds to the process in the frequency domain in which spectra of all bands are added. Accordingly, if these filters are idealistic, the result will be the same as a spectrum obtained by adding $Y_m(k)$ for each band, and, as a result, an input FFT spectrum can be obtained. Also, if these filters approximate an idealistic filter, an approximate spectrum can be obtained, which a psychoacoustic model according to the present invention uses.

As the results of experiments, even when filters used are not ideal band-pass filters, if the filters are a filter bank used in the MPEG-1 layer 3, the spectrum obtained by the method described above was similar to the actual spectrum.

Thus, the spectrum of an input signal can be obtained by adding CMDCT spectra in all bands. While the spectrum obtained by using CMDCT is 1152 points, the spectrum needed in the psychoacoustic model is 1024 points. Accordingly, the CMDCT spectrum is re-sampled by using simple linear mapping, and then can be used in the psychoacoustic model.

Figure 6:
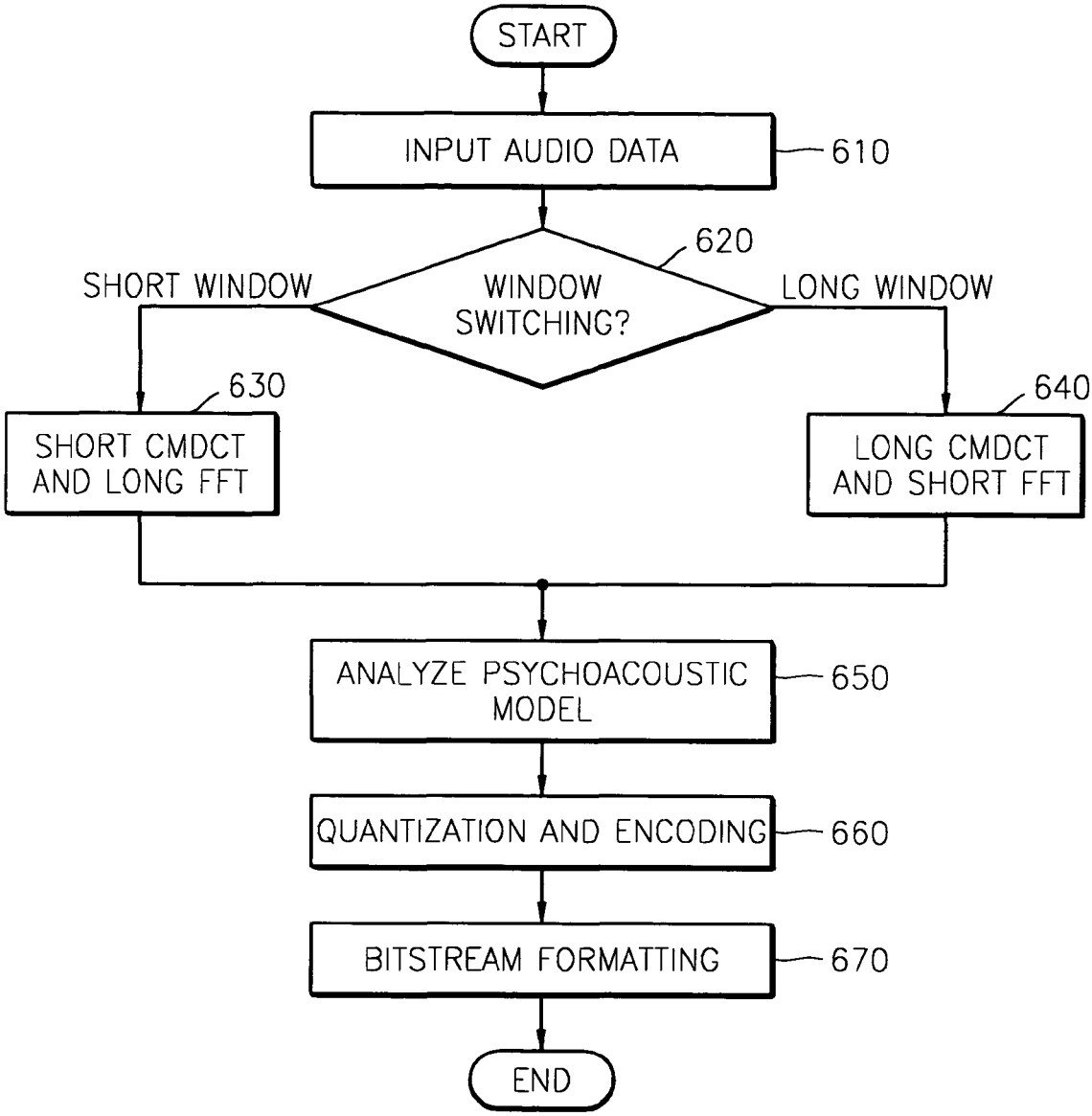
FIG. 6 is a flowchart of the steps performed by an MPEG audio encoding method according to another preferred embodiment of the present invention.

FIG. 6 is a flowchart of the steps performed by an MPEG audio encoding method according to another preferred embodiment of the present invention.

In step 610, an audio signal is input to the filter bank, and the input time domain audio signal is divided into frequency domain subbands in order to remove the statistical redundancy of the input audio signal.

In step 620, based on the characteristic of the input audio signal, the window type is determined. If the input signal is a transient signal, step 630 is performed, and if the input signal is not a transient signal, step 640 is performed.

In step 630, by applying a short window to the audio data processed in the step 610, short CMDCT is performed, and at the same time, by applying a long window, long FFT is performed. As a result, a short CMDCT spectrum and a long FFT spectrum are obtained.

In step 640, by applying a long window to the audio data processed in the step 610, long CMDCT is performed, and at the same time, by applying a short window, short FFT is performed. As a result, a long CMDCT spectrum and a short FFT spectrum are obtained.

In step 650, if the window type determined in the step 620 is a short window, by using the short CMDCT spectrum and long FFT spectrum obtained in the step 630, unpredictability used in the psychoacoustic model is calculated.

If the window type determined in the step 620 is a long window, by using the long CMDCT spectrum and short FFT spectrum obtained in the step 640, unpredictability is calculated. Also, based on the calculated unpredictability, the SMR value is calculated.

In step 660, quantization of the audio data obtained in the step 610 is performed according to the SMR value calculated in the step 650, and Huffman encoding of the quantized data is performed.

In step 670, the data encoded in the step 660 is converted into a signal having a predetermined format and then the signal is output. If the audio encoding method is an MPEG audio encoding method, the data is converted into a signal having a format specified by the MPEG standards.

Figure 7:
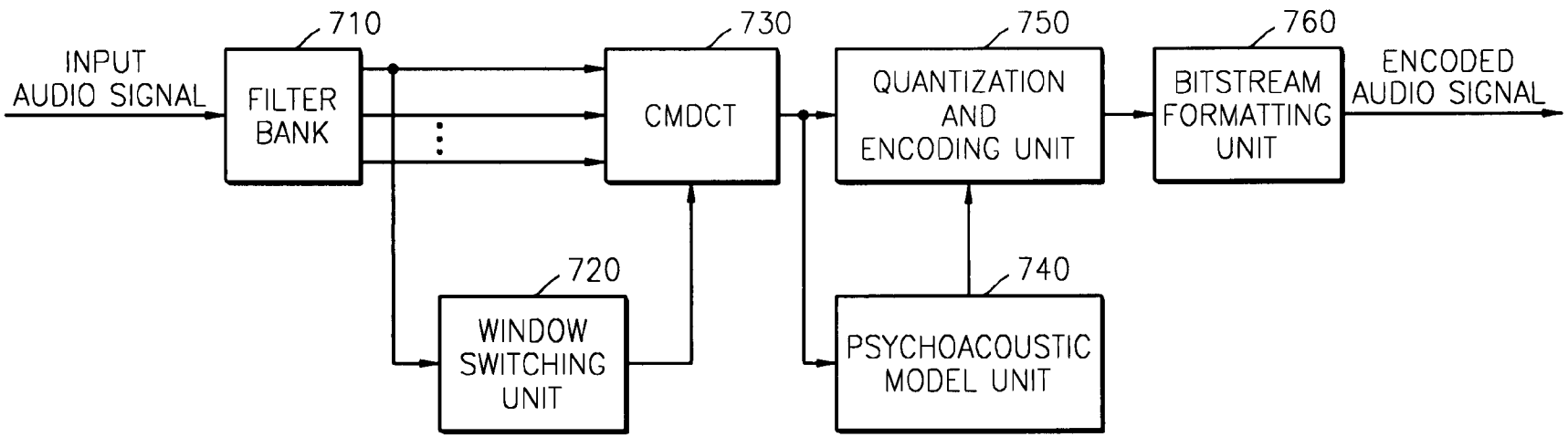
FIG. 7 is a block diagram of an MPEG audio encoding apparatus according to another preferred embodiment of the present invention.

FIG. 7 is a block diagram explaining an audio encoding apparatus according to another preferred embodiment of the present invention.

The audio encoding apparatus shown in FIG. 7 comprises a filter bank unit 710, a window switching unit 720, a CMDCT unit 730, a psychoacoustic model unit 740 a quantization and encoding unit 750, and a bitstream formatting unit 760.

Here, for simplification of explanation, explanations of the filter bank unit 710, the quantization and encoding unit 750, and the bitstream formatting unit 760 will be omitted because these units perform functions similar to that of the filter bank unit 210, the quantization and encoding unit 260, and the bitstream formatting unit 270, respectively, of FIG. 2.

The window switching unit 720, based on the characteristic of the input audio signal, determines the type of a window to be used in the CMDCT unit 730, and sends the determined window type information to the CMDCT unit 730.

The CMDCT unit 730 calculates a long CMDCT spectrum and a short CMDCT spectrum together. In the present embodiment, the long CMDCT spectrum used in the psychoacoustic model unit 740 is obtained by performing 36 point CMDCT, adding all the results, and then re-sampling the spectrum having a length of 1152 into a spectrum having a length of 1024. Also, the short CMDCT spectrum used in the psychoacoustic model unit 740 is obtained by performing 12 point CMDCT, adding all the results, and then re-sampling the resulting spectrum having a length of 384 into a spectrum having a length of 256.

The CMDCT unit 730 outputs the calculated long CMDCT spectrum and short CMDCT spectrum to the psychoacoustic model unit 740. Also, if the window type input from the window switching unit 720 is a long window, the CMDCT unit 730 inputs the long MDCT spectrum to the quantization and encoding unit 750, and if the input window type is a short window, inputs the short MDCT spectrum to the quantization and encoding unit 750.

The psychoacoustic model unit 740 calculates unpredictability according to the long spectrum and short spectrum sent from the CMDCT unit 730 and, based on the calculated unpredictability, calculates the SMR value. The calculated SMR value is sent to the quantization and encoding unit 750.

The quantization and encoding unit 750, based on the long MDCT spectrum and short MDCT spectrum sent from the CMDCT unit 730 and the SMR information input from the psychoacoustic model unit 740 determines scale factors and quantization coefficients. Based on the determined quantization coefficients, quantization is performed and Huffman encoding of the quantized data is performed.

The bitstream formatting unit 760 converts the data input from the quantization and encoding unit 750 into a signal having a predetermined format and outputs the signal. If the audio encoding apparatus is an MPEG audio encoding apparatus, the data is converted into a signal having a format specified by the MPEG standards and output.

Figure 8:
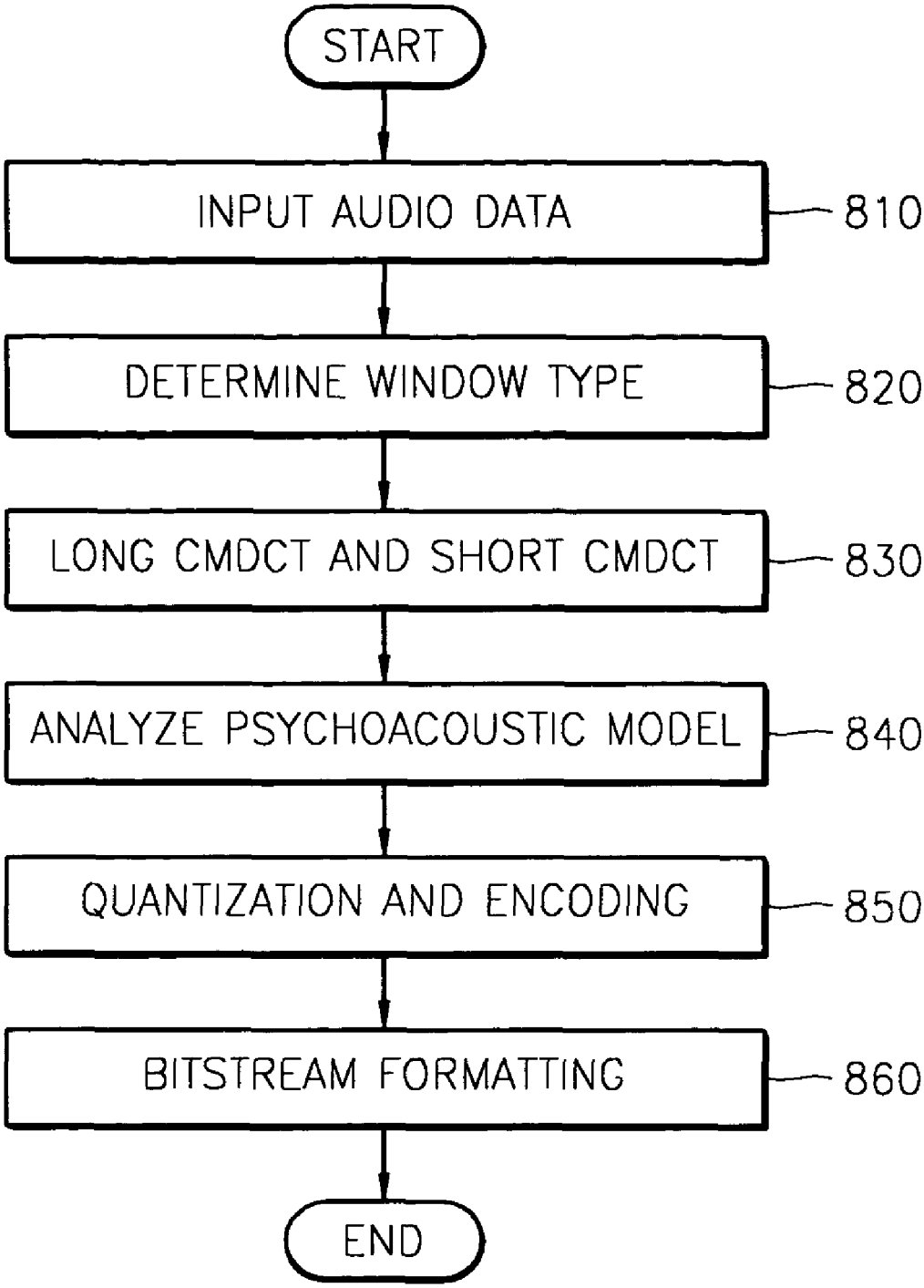
FIG. 8 is a flowchart of the steps performed by an MPEG audio encoding method according to still another preferred embodiment of the present invention.

FIG. 8 is a flowchart of the steps performed by an MPEG audio encoding method according to still another preferred embodiment of the present invention.

In step 810, the filter bank receives an audio signal, and in order to remove the statistical redundancy of the input audio signal, the input time domain audio signal is divided into frequency domain subbands.

In step 820, based on the characteristic of the input audio signal, the window type is determined.

In step 830, by applying a short window to the audio data processed in the step 810, short CMDCT is performed, and at the same time, by applying a long window, long CMDCT is performed. As a result, a short CMDCT spectrum and a long CMDCT spectrum are obtained.

In step 840, by using the short CMDCT spectrum and long CMDCT spectrum obtained in the step 830, unpredictability to be used in the psychoacoustic model is calculated. Also, based on the calculated unpredictability, the SMR value is calculated.

In step 850, if the window type determined in the step 820 is a long window, the long MDCT value in the spectrum obtained in the step 830 is input, quantization of the long MDCT value is performed according to the SMR value calculated in the step 840, and Huffman encoding of the quantized data is performed.

In step 860, the data encoded in the step 850 is converted into a signal having a predetermined format and then the signal is output. If the audio encoding method is an MPEG audio encoding method, the data is converted into a signal having a format specified by the MPEG standards.

The present invention is not limited to the preferred embodiment described above, and it is apparent that variations and modifications by those skilled in the art can be effected within the spirit and scope of the present invention. In particular, in addition to the MPEG-1 layer 3, the present invention can be applied to all audio encoding apparatuses and methods that use MDCT and the psychoacoustic model, such as MPEG-2 advanced audio coding (AAC), MPEG-4, and windows media audio (WMA).

The present invention may be embodied in a code, which can be read by a computer, on a computer readable recording medium. The computer readable recording medium includes all kinds of recording apparatuses on which computer readable data are stored.

The computer readable recording media includes storage media such as magnetic storage media (e.g., ROM's, floppy disks, hard disks, etc.), and optically readable media (e.g., CD-ROMs, DVDs, etc.). Also, the computer readable recording media can be scattered on computer systems connected through a network and can store and execute a computer readable code in a distributed mode.

As described above, by applying the advanced psychoacoustic model according to the present invention, the CMDCT spectrum is used instead of the FFT spectrum such that the amount of computation needed in FFT transform and the complexity of an MPEG audio encoder can be decreased without degrading the sound quality of an output audio stream compared to the input audio signal.

What is claimed is:

1. A digital audio encoding method comprising:

(a) determining a type of a window according to a characteristic of an input audio signal;

(b) generating a complex modified discrete cosine transform (CMDCT) spectrum from the input audio signal according to the determined window type;

(c) generating a fast Fourier transform (FFT) spectrum from the input audio signal, by using the determined window type; and (d) performing a psychoacoustic model analysis, by using the generated CMDCT spectrum and FFT spectrum.

2. The method of claim 1, wherein operation (a) further comprises:

(a1) dividing the input audio signal into a plurality of subbands by filtering the input audio signal, and wherein operation (a) is performed for the input audio signal divided into subbands.

3. The method of claim 2, wherein operation (a1) is performed by a poly-phase filter bank.

4. The method of claim 1, wherein if the window type determined in operation (a) is a long window, a long CMDCT spectrum is generated by applying a long window in operation (b), a short FFT spectrum is generated by applying a short window in operation (c), and the psychoacoustic model analysis is performed based on the generated long CMDCT spectrum and short FFT spectrum in operation (d).

5. The method of claim 1, wherein if the window type determined in operation (a) is a short window, a short CMDCT spectrum is generated by applying a short window in operation (b), a long FFT spectrum is generated by applying a long window in operation (c), and the psychoacoustic model analysis is performed based on the generated short CMDCT spectrum and long FFT spectrum in operation (d).

6. The method of claim 1, wherein in operation (a), if the input audio signal is a transient signal, the type of the window is determined as a short window, and if the input audio signal is not a transient signal, the type of the window is determined as a long window.

7. The method of claim 1, further comprising:

(e) performing quantization and encoding based on the result of the psychoacoustic model analysis performed in operation (d).

8. The method of claim 1, wherein the psychoacoustic model is a model used by one in a group comprising a motion picture experts group (MPEG)-1 layer 3, an MPEG-2 advanced audio coding (AAC), an MPEG-4, and a windows media audio (WMA).

9. The method of claim 1, wherein the performing the psychoacoustic model analysis comprises obtaining an audio masking threshold used for encoding of the input audio signal.

10. A digital audio encoding apparatus comprising:

a window switching unit which determines a type of a window according to a characteristic of an input audio signal;

a CMDCT unit which generates a CMDCT spectrum from the input audio signal according to the window type determined in the window switching unit;

an FFT unit which generates an FFT spectrum from the input audio signal, by using the window type determined in the window switching unit; and a psychoacoustic model unit which performs a psychoacoustic model analysis by using the CMDCT spectrum generated in the CMDCT unit and the FFT spectrum generated in the FFT unit.

11. The apparatus of claim 10, wherein the encoding apparatus further comprises a filter unit which divides the input audio signal into a plurality of subbands by filtering the input audio signal, and the window switching unit determines the window type based on the output data of the filter unit.

12. The apparatus of claim 11, wherein the filter unit is a poly-phase filter bank.

13. The apparatus of claim 10, wherein if the window type determined in the window switching unit is a long window, the CMDCT unit generates a long CMDCT spectrum by applying a long window, the FFT unit generates a short FFT spectrum by applying a short window, and the psychoacoustic model unit performs the psychoacoustic model analysis based on the long CMDCT spectrum generated in the CMDCT unit and the short FFT spectrum generated in the FFT unit.

14. The apparatus of claim 10, wherein if the window type determined in the window switching unit is a short window, the CMDCT unit generates a short CMDCT spectrum by applying the short window, the FFT unit generates a long FFT spectrum by applying a long window, and the psychoacoustic model unit performs the psychoacoustic model analysis, based on the short CMDCT spectrum generated in the CMDCT unit and the long FFT spectrum generated in the FFT unit.

15. The apparatus of claim 10, wherein if the input audio signal is a transient signal, the window switching unit determines the type of the window as a short window, and if the input audio signal is not the transient signal, determines the type of the window as a long window.

16. The apparatus of claim 10, further comprising:

a quantization and encoding unit which performs quantization and encoding based on the audio data from the CMDCT unit and resultant values of the psychoacoustic model unit.

17. The apparatus of claim 10, wherein the psychoacoustic model is a model used by one in a group comprising an MPEG-1 layer 3, an MPEG-2 AAC, an MPEG-4, and a WMA.

18. A digital audio encoding method comprising:

(a) generating a CMDCT spectrum from an input audio signal; and (b) performing a psychoacoustic model analysis by using the generated CMDCT spectrum, wherein operation (a)

further comprises (a1) generating a long CMDCT spectrum and a short CMDCT spectrum by performing CMDCT by applying a long window and a short window to an input audio signal, and wherein, in operation (a), the CMDCT by applying the long window and the CMDCT by applying the short window are performed at the same time.

19. The method of claim 18, wherein in operation (b) a psychoacoustic model analysis is performed by using the long CMDCT spectrum and short CMDCT spectrum generated in operation (a1).

20. The method of claim 18, wherein operation (a) further comprises:

(a1) dividing the input audio signal into a plurality of subbands by filtering the input audio signal, and wherein operation (a) is performed for the input audio signal divided into subbands.

21. The method of claim 20, wherein operation (a1) is performed by a poly-phase filter bank.

22. The method of claim 18, further comprising:

(a1) determining a type of a window to be used for operation (a), according to a characteristic of the input audio signal.

23. The method of claim 22, wherein in operation (a1) if the input audio signal is a transient signal, the window type is determined as a short window, and if the input audio signal is not the transient signal, the window type is determined as a long window.

24. The method of claim 23, wherein if the window type determined in operation (a1) is the long window, quantization and encoding of a long MDCT spectrum are performed based on a result of the psychoacoustic model analysis performed in operation (b), and if the window type determined in operation (a1) is the short window, quantization and encoding of a short MDCT spectrum are performed based on the result of the psychoacoustic model analysis performed in operation (b).

25. The method of claim 18, wherein the psychoacoustic model is a model used by one in a group comprising an MPEG-1 layer 3, an MPEG-2 AAC, an MPEG-4, and a WMA.

26. A digital audio encoding apparatus comprising:

a CMDCT unit which generates a CMDCT spectrum from an input audio signal; and a psychoacoustic model unit which performs a psychoacoustic model analysis by using the CMDCT spectrum generated in the CMDCT unit, wherein the CMDCT unit generates a long CMDCT spectrum and a short CMDCT spectrum by performing a CMDCT by applying a long window and a short window to the input audio signal, and wherein the CMDCT by applying the long window and the CMDCT by applying the short window are performed at the same time.

27. The apparatus of claim 26, wherein the psychoacoustic model unit performs a psychoacoustic analysis by using the long CMDCT spectrum and short CMDCT spectrum generated in the CMDCT unit.

28. The apparatus of claim 26, further comprising:

a filter unit which divides the input audio signal into a plurality of subbands by filtering the input audio signal, wherein the CMDCT unit performs CMDCT for the data divided into subbands.

29. The apparatus of claim 28, wherein the filter unit is a poly-phase filter bank.

30. The apparatus of claim 26, further comprising:

a window type determining unit which determines a type of a window, according to a characteristic of the input audio signal.

31. The apparatus of claim 30, wherein, if the input audio signal is a transient signal, the window type determining unit determines the window type as a short window, and if the input audio signal is not the transient signal, determines the window type as a long window.

32. The apparatus of claim 31, further comprising:

a quantization and encoding unit wherein if the window type determined in the window type determining unit is the long window, the quantization and encoding unit performs quantization and encoding of a long MDCT spectrum, based on a result of the psychoacoustic model analysis performed in the psychoacoustic model unit, and if the window type determined in the window type determining unit is the short window, performs quantization and encoding of a short MDCT spectrum, based on the result of the psychoacoustic model analysis performed in the psychoacoustic model unit.

33. The apparatus of claim 26, wherein the psychoacoustic model is a model used by one in a group comprising an MPEG-1 layer 3, an MPEG-2 AAC, an MPEG-4, and a WMA.

34. A computer-readable recording medium for recording a computer program code for enabling a computer to provide a service of encoding input audio signals, the service comprising operations of:

(a) determining a type of a window according to a characteristic of an input audio signal;

(b) generating a complex modified discrete cosine transform (CMDCT) spectrum from the input audio signal according to the determined window type;

(c) generating a fast Fourier transform (FFT) spectrum from the input audio signal, by using the determined window type; and (d) performing a psychoacoustic model analysis, by using the generated CMDCT spectrum and FFT spectrum.

35. The computer-readable recording medium of claim 34, wherein operation (a) further comprises:

(a1) dividing the input audio signal into a plurality of subbands by filtering the input audio signal, and wherein operation (a) is performed for the input audio signal divided into subbands.

36. The computer-readable recording medium of claim 35, wherein operation (a1) is performed by a poly-phase filter bank.

37. The computer-readable recording medium of claim 34, wherein if the window type determined in operation (a) is a long window, a long CMDCT spectrum is generated by applying a long window in operation (b), a short FFT spectrum is generated by applying a short window in operation (c), and the psychoacoustic model analysis is performed based on the generated long CMDCT spectrum and short FFT spectrum in operation (d).

38. The computer-readable recording medium of claim 34, wherein if the window type determined in operation (a) is a short window, a short CMDCT spectrum is generated by applying a short window in operation (b), a long FFT spectrum is generated by applying a long window in operation (c), and the psychoacoustic model analysis is performed based on the generated short CMDCT spectrum and long FFT spectrum in operation (d).

39. The computer-readable recording medium of claim 34, wherein in operation (a), if the input audio signal is a transient signal, the type of the window is determined as a short window, and if the input audio signal is not a transient signal, the type of the window is determined as a long window.

40. The computer-readable recording medium of claim 34, further comprising:

(e) performing quantization and encoding based on the result of the psychoacoustic model analysis performed in operation (d).

* * * * *